US009687094B2

(12) United States Patent
Farmer et al.

(10) Patent No.: US 9,687,094 B2
(45) Date of Patent: Jun. 27, 2017

(54) MUG STACKING DEVICE

(71) Applicants: Heidi R. Farmer, Lafayette, CO (US); Samuel J. Farmer, Lafayette, CO (US)

(72) Inventors: Heidi R. Farmer, Lafayette, CO (US); Samuel J. Farmer, Lafayette, CO (US)

( * ) Notice: Subject to any disclaimer, the term of this patent is extended or adjusted under 35 U.S.C. 154(b) by 0 days.

(21) Appl. No.: 14/622,890

(22) Filed: Feb. 15, 2015

(65) Prior Publication Data

US 2016/0235230 A1 Aug. 18, 2016

(51) Int. Cl.

| | |
|---|---|
| ***B65D 25/38*** | (2006.01) |
| ***A47G 19/23*** | (2006.01) |
| ***B65D 21/02*** | (2006.01) |
| ***A47G 23/02*** | (2006.01) |

(52) U.S. Cl.

CPC ..... *A47G 19/23* (2013.01); *A47G 23/0216* (2013.01); *B65D 21/0224* (2013.01)

(58) Field of Classification Search

CPC ..... B65G 57/03; B65D 21/0224; A47G 19/23
USPC ..... 215/392, 293; 206/821; 220/716, 718, 220/740

See application file for complete search history.

(56) References Cited

U.S. PATENT DOCUMENTS 1,937,939 A * 12/1933 Behrens ..... A47G 19/22 206/223
2,559,362 A * 7/1951 Langfeld ..... B67B 7/28 220/718
3,173,574 A * 3/1965 Goldsmith ..... B65D 21/022 206/508
3,185,341 A * 5/1965 Barbour ..... B65D 25/48 220/260
3,317,087 A * 5/1967 Landis ..... B65D 47/265 206/427
3,724,654 A 4/1973 Gerard et al.
3,885,672 A * 5/1975 Westenrieder ..... B65D 71/502 206/503
4,098,439 A * 7/1978 Blow, Jr. ..... B65D 25/20 220/718
4,673,089 A 6/1987 Chap
4,693,410 A * 9/1987 Selz ..... A47G 19/2205 215/228
4,930,636 A * 6/1990 Meadows ..... B65D 21/0224 206/503
5,000,338 A * 3/1991 Wolman ..... B65D 25/50 220/718
5,060,820 A * 10/1991 Boerner ..... A47G 19/065 206/501
5,123,558 A * 6/1992 Moloney ..... A47G 23/03 220/212
5,219,419 A 6/1993 Prothe
5,273,176 A * 12/1993 Diaz ..... B65D 43/169 220/258.2

(Continued)

*Primary Examiner* — King M Chu
(74) *Attorney, Agent, or Firm* — James L. Farmer

(57) ABSTRACT

Methods and apparatus are provided for a platform adapted to fit atop a first drinking container and provide a stable surface for securely supporting a second drinking container stacked atop the first. In one exemplary embodiment the platform is a flat circular plate bounded at a perimeter edge by a first cylindrical wall on one side of the plate and a second cylindrical wall on the other side of the plate. The cylindrical walls may each include a cut-out to provide clearance for a handle on one of the drinking containers.

14 Claims, 5 Drawing Sheets

(56) References Cited

U.S. PATENT DOCUMENTS

| | | | | | |
|---|---|---|---|---|---|
| 5,570,797 | A * | 11/1996 | Yeh | A47G 23/03 | 215/228 |
| 5,839,596 | A * | 11/1998 | Zahn | B65D 81/3876 | 220/256.1 |
| 5,860,559 | A * | 1/1999 | Wang | A47G 23/0208 | 220/632 |
| 6,311,864 | B1 * | 11/2001 | Land | B65D 47/06 | 220/718 |
| 6,450,358 | B1 * | 9/2002 | Berro | B65D 25/48 | 220/254.7 |
| 8,720,717 | B2 * | 5/2014 | Kaanta | B65D 17/161 | 215/303 |
| 8,899,435 | B1 * | 12/2014 | Reder | A47G 19/2205 | 206/507 |
| 9,038,826 | B2 | 5/2015 | Cocci | | |
| 2001/0022304 | A1 * | 9/2001 | Roche | B65D 43/0229 | 220/212 |
| 2007/0095829 | A1 * | 5/2007 | Ruccolo | A47G 19/2272 | 220/23.87 |
| 2011/0220670 | A1 * | 9/2011 | Poole | B65D 81/3879 | 220/739 |

* cited by examiner

MUG STACKING DEVICE

TECHNICAL FIELD AND BACKGROUND

The technical field of the present invention relates to containers typically used for drinking liquids, such as cups, mugs, glasses and the like.

DESCRIPTION OF THE EMBODIMENTS

Figure 1:
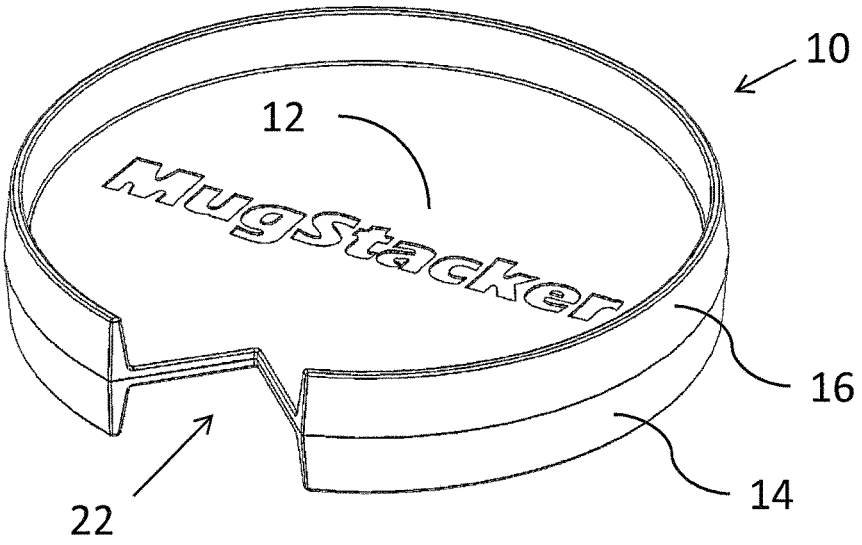
FIG. 1 is a perspective view of an exemplary mug stacking device in accordance with the present disclosure.

The instant invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list. The term "mug" is used interchangeably with other terms such as "cup" and "glass", and may refer to any container for drinking liquid, including drinking containers with a handle such as a coffee or tea cup.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

It is of course well known to save space in a kitchen cabinet or pantry by stacking dishware such as plates, bowls, and certain types of drinking containers. The present inventors have recognized however that some types of drinking containers are easily stackable, while other types are not. For example, while cups and glasses with straight tapered sides are often quite stackable one inside another, certain other containers such as tall glasses with substantially straight non-tapered sides, wine glasses, and in particular containers with handles such as coffee cups and tea cups, are not easily stacked. The inventors have further recognized an apparently unrealized need for a way to stack such drinking containers without risk of the container toppling or becoming damaged in the process.

Referring now specifically to the drawings, an exemplary mug stacking device in accordance with the present disclosure is indicated at reference numeral 10. The mug stacking device comprises essentially a stable platform placed atop a first drinking container, onto which a second drinking container may be securely stacked. More particularly, the device comprises a flat circular plate 12 bounded by a first cylindrical wall 14 extending substantially orthogonally from one side of the plate, and a second cylindrical wall 16 extending in an opposite direction from the other side of the plate. The walls are relatively low compared to the diameter of the circular plate 12, producing a shallow dish shape on each side of the device, similar to that of a glass pitre dish or a threaded jar cap. Due to this novel shape, the mug stacking device provides a uniquely stable platform when placed atop a mug for securely supporting one mug on top of another.

The mug stacking device may be made from various stiff or semi-stiff materials, such as for example, plastic, metal, wood, or various composites, although it will be appreciated that the relatively simple shape advantageously lends itself to plastic injection molding. In one embodiment the material used is an injection moldable plastic with a somewhat sticky or tacky surface quality. Such surface properties can be obtained without significant adverse effect on material strength or stiffness by known methods, such as through use of certain additives or by selectively varying certain processing conditions such as curing time or temperature. Suitable materials include various polyolefin based elastomers, and in particular a thermoplastic vulcanizate polyolefin based elastomer manufactured by Exxon Mobile, and distributed under the trade name Santoprene.

Figure 2:
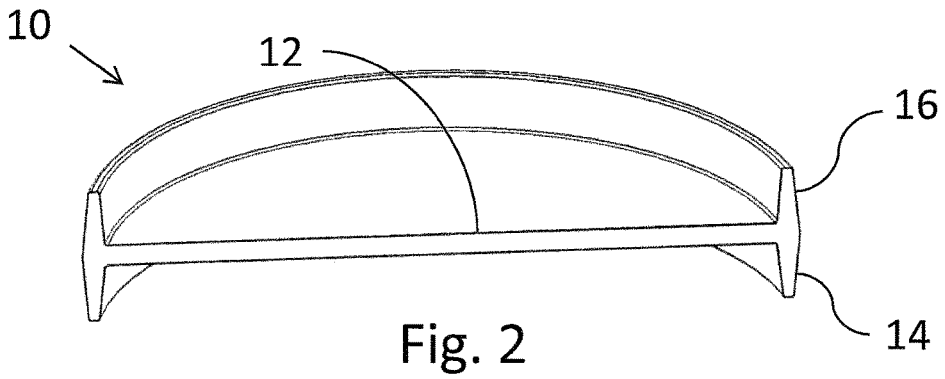
FIG. 2 is a cut-away view of the mug stacking device of FIG. 1.
Figure 3:
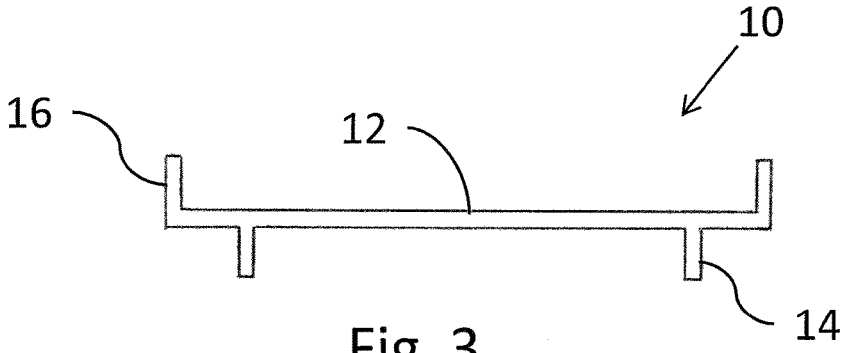
FIG. 3 is a cross-section view of another embodiment of the mug stacking device with one cylindrical wall recessed from the outer edge of the device.

The mug stacking device may be symmetrical, with both cylindrical walls the same height, and both coinciding with a perimeter edge of circular plate 12 as depicted in FIGS. 1 and 2. In such an embodiment the walls may be perfectly aligned with each other, so that together they present one smooth, contiguous outer cylindrical surface. Alternatively, the device may have an asymmetrical shape, such as that of FIG. 3, in which one of the walls is recessed from the perimeter edge of the plate giving a stepped appearance. Such a configuration may be particularly useful for example when stacking a relatively small diameter mug over a larger mug. Other asymmetries such as differences in wall height, or variations in wall or plate thickness are also possible, and intended to be within the contemplated scope of the present invention.

Figure 4:
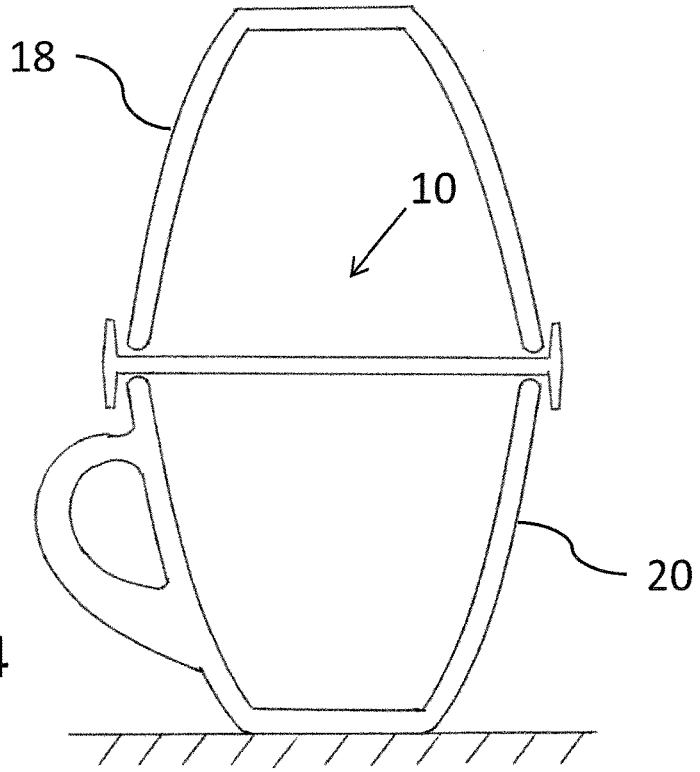
FIG. 4 is a cross-section view of a mug stacking device in use, positioned between two stacked mugs.
Figure 5:
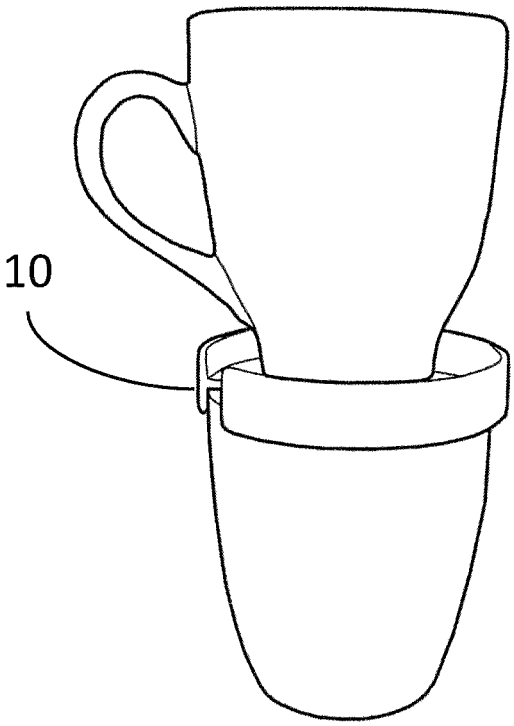
FIGS. 5 through 7 are elevation views showing the mug stacking device in use between stacked mugs, with the mugs arranged in alternative stacking orientations to that of FIG. 4.
Figure 6:
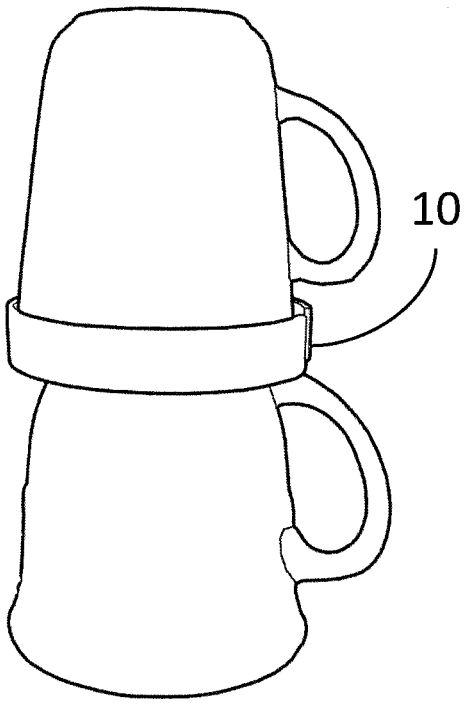
Figure 7:
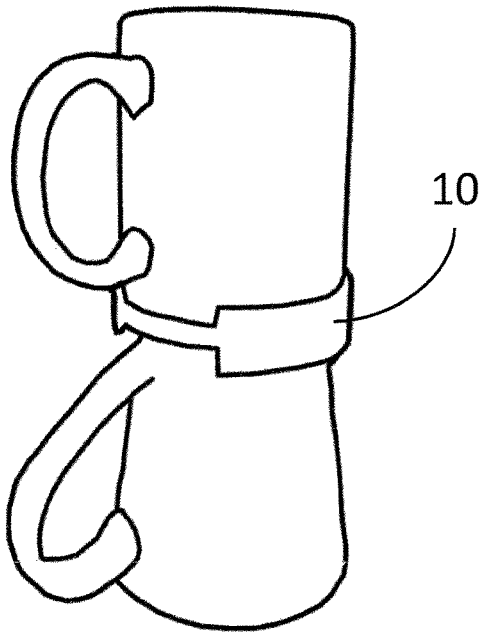

Referring now to the cross-section view of FIG. 4, the mug stacking device is shown in use positioned between two stacked mugs 18 and 20. The mug stacking device is preferably sized such that the cylindrical walls 14, 16, fit around the mugs with clearance, allowing the rims of the mugs to rest flat against the circular plate 12. The inside diameter of the cylindrical walls may be selected so that the device will fit around the larger end of most typical coffee mugs. For example, the inside diameter of the walls may be in a range of between about 3.0 and 5.0 inches, and in a more specific embodiment approximately 3.7 inches. While FIG. 4 shows the mugs stacked with the top (open end) of both mugs facing the mug stacking device, FIGS. 5 through 7 depict alternative stacking arrangements in which the bottom end of one or both mugs is facing the mug stacking device.

The cylindrical walls may be as short as practical while ensuring that the rims of the stacked mugs stay confined and do not slip over the walls due to the normal pushing and bumping that typically occurs when handling dishware. While any amount of perimeter wall is helpful compared to a flat plate with no wall, the inventors have determined that a wall height of between about 0.2 and 0.4 inches as measured from the circular plate is generally sufficient for most mugs. Alternatively, the height of the cylindrical walls may be quantified as a factor multiplied by the diameter of plate 12, where the factor is less than one. In that case the inventors have discovered that a multiplying factor of about 0.05 to 0.1 also results in a wall with sufficient height for a wide range of mug sizes.

Figure 8:
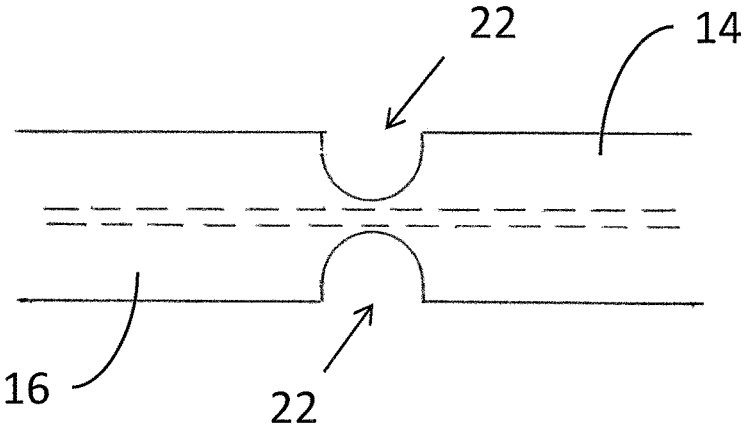
FIG. 8 is an end view of the mug stacking device showing cut-outs in the cylindrical wall portions of the device.

Referring to FIG. 8, the cylindrical walls 14, 16 may also include a cut-out, or gap 22 to accommodate a handle or other protruding feature on a mug. Each wall may have one, or a plurality of cut-outs 22 that extend part way or all the way from the free edge 24 of the wall to the circular plate 12. In the particular embodiment shown in FIG. 1, the cut-outs comprise gaps in the walls at the same location on both walls that include a wedge-shaped portion of the circular plate 12.

The walls and circular plate are generally thick enough so that any bending or deformation of the mug stacking device is insubstantial when supporting a mug of typical weight and size. The actual thickness required is to some extent material dependent. For example, a mug stacking device made of a relatively flexible plastic may require more thickness than one made of a more rigid material such as fiberglass or aluminum. In addition, the thickness of the circular plate and walls may be uniform, or it may vary. For mug stacking devices made of plastic, the inventors have discovered that plate and wall thicknesses of between about 0.02 and 0.06 inches are generally sufficient.

Figure 9:
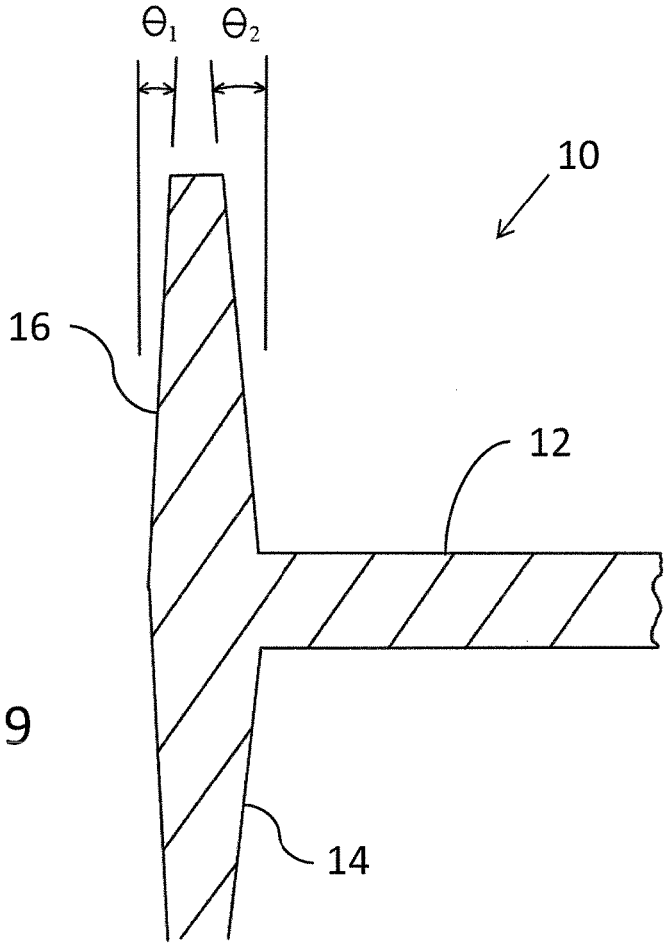
FIG. 9 is a cross section of an exemplary mug stacking device showing tapered perimeter walls defined by inner and outer draft angles.

Referring now to FIG. 9, the walls 14, 16, may taper from a maximum thickness where the walls meet the circular plate, to a minimum thickness at the opposite, or free edge 24. The taper may be linear, with the amount of taper defined in terms of outer and inner draft angles $\theta_1$ and $\theta_2$ respectively. Such a tapered shape acts to reduce material where not needed, and in a plastic injection molded embodiment also facilitates release of the parts from the mold. In addition, the taper on the inner surface, as defined by angle $\theta_2$, advantageously serves to help guide and pilot the mug stacking device onto the mugs. In one exemplary injection molded plastic embodiment, the draft angles $\theta_1$ and $\theta_2$ are both between about 3 and 6 degrees.

One example of a mug stacking device in accordance with the present disclosure is quantified in Table 1 below. Table 1 assumes an embodiment such as that shown in FIGS. 1, 2, and 4-9, wherein both cylindrical walls are of the same height, and both walls coincide with a perimeter edge of the circular plate, together defining one contiguous cylindrical outer surface of the mug stacking device.

TABLE 1

| | |
|---|---|
| Maximum outside diameter: | 4.0 in. |
| Height of walls 14, 16, from plate 12: | 0.3 in. |
| Minimum inside diameter of walls 14, 16: | 3.7 in. |
| Outer draft angle $\theta_1$: | 5 deg. |
| Inner draft angle $\theta_2$: | 5 deg. |
| Thickness of plate 12: | .04 in. |
| Material: | Plastic |

Following is a brief description of an exemplary method of using the mug stacking device to stack one mug atop another. It should be noted that the mug stacking device may be used with the first mug oriented with the open end facing either up or down, however for purposes of the present description an open-end-up orientation will be assumed.

The process begins by placing the first mug on a level surface such as a counter top, or shelf in a cabinet. The mug stacking device is then placed atop the first mug such that the downward facing side of the circular plate 12 is resting on the rim of the mug, and the downward extending wall 14, 16, surrounds the rim. If a handle or other localized feature on the mug is preventing the mug stacking device from sitting flat on the mug rim, the mug stacking device may be rotated relative to the mug until the localized feature fits inside the cut-out 22 in the wall, and the circular plate is in contact with the mug all the way around the rim.

With the device thus properly seated on the first mug, a second mug is placed directly on the mug stacking device. The second mug will be assumed to be oriented with the open end facing down for the present description, although the mug stacking device will work equally well with the second mug facing the opposite way instead. When properly positioned, the rim of the second mug rests flat on the upward facing side of the circular plate 12, and is surrounded by the upward extending wall of the mug stacking device. Again if a handle or other localized feature of the mug is interfering, the mug may be rotated relative to the mug stacking device until the localized feature aligns with the cut-out 22, and rim of the second mug sits flat on the circular plate 12. To unstack the mugs the above process is simply reversed.

There has been described a novel one-piece, inexpensive mug stacking device that allows various drinking containers to be easily stacked one on top of another without risk of toppling or breaking. For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed is:

1. A unitary device adapted to fit atop a first drinking container and provide a stable surface for securely supporting a second drinking container stacked atop the first, the device comprising;

a flat circular plate;

a first cylindrical wall integral with, and concentrically disposed on one side of the circular plate proximate a perimeter edge of the plate, the first cylindrical wall extending from the plate to a first free edge at a first height;

a second cylindrical wall integral with, and concentrically disposed on the other side of the circular plate proximate the perimeter edge of the plate, the second cylindrical wall extending from the plate in a direction opposite the first wall to a second free edge at a second height;

a cut-out in the first cylindrical wall extending from the first free edge toward the circular plate to create a circumferential gap in the first cylindrical wall wide enough to receive a handle of a drinking container; and a cut-out in the second cylindrical wall extending from the second free edge toward the circular plate to create a circumferential gap in the second cylindrical wall wide enough to receive a handle of a drinking container, wherein the cut-outs in the first and second cylindrical walls are aligned with each other and include a perimeter portion of the circular plate.

2. The device of claim 1, wherein the heights of the first and second walls are between about 0.2 and 0.4 inches.

3. The device of claim 1, wherein the first and second heights are the same, and the cylindrical walls are aligned with each other at the perimeter edge of the circular plate, together defining one contiguous cylindrical outer surface of the device.

4. The device of claim 1, wherein the circular plate and walls are a single piece of injection molded plastic.

5. The device of claim 4, wherein both cylindrical walls taper down in thickness with distance from the circular plate, the amount of taper determined by an inner draft angle on an inner diameter surface of each wall, and an outer draft angle on an outer diameter surface of each wall.

6. The device of claim 5, wherein the inner draft angle and outer draft angle are both approximately five degrees.

7. The device of claim 5, wherein the thickness of the circular plate is between about 0.02 to 0.06 inches, and an inside diameter of the cylindrical walls is between about 3.0 and 5.0 inches.

8. The device of claim 7, wherein the thickness of the circular plate, and a maximum thickness of the cylindrical walls is about 0.04 inches, and wherein the inside diameter of the cylindrical walls is about 3.7 inches.

9. A platform adapted to fit atop a first drinking container and provide a stable surface for securely supporting a second drinking container stacked atop the first, comprising:

a flat circular plate bounded at a perimeter edge by a first cylindrical wall on one side of the plate and a second cylindrical wall on the other side of the plate, wherein the height of each cylindrical wall is less than about one tenth of a diameter to the perimeter edge of the circular plate;

a cut-out in the first cylindrical wall extending from a free edge of the first cylindrical wall toward the circular plate to create a circumferential gap in the first cylindrical wall wide enough to receive a handle of a drinking container; and a cut-out in the second cylindrical wall extending from a free edge of the second cylindrical wall toward the circular plate to create a circumferential gap in the second cylindrical wall wide enough to receive a handle of a drinking container, wherein the cut-outs in the first and second cylindrical walls are at the same circumferential location on both walls and include a perimeter portion of the circular plate.

10. The platform of claim 9, wherein the first and second cylindrical walls are coincident with the perimeter edge of the circular plate, and together define a contiguous cylindrical outer surface of the device.

11. The platform of claim 10, wherein both cylindrical walls taper down in thickness with distance from the circular plate toward the respective free edges, the amount of taper determined by an inner draft angle on an inner diameter surface of each wall, and an outer draft angle on an outer diameter surface of each wall.

12. The platform of claim 11, wherein the inner draft angle and outer draft angle are both approximately five degrees.

13. The device of claim 9, wherein the circular plate and walls are a single unitary piece of injection molded plastic.

14. The device of claim 13, wherein the injection molded plastic has a tacky surface quality.

* * * * *